US007574283B2

(12) United States Patent
Wang et al.

(10) Patent No.: US 7,574,283 B2
(45) Date of Patent: Aug. 11, 2009

(54) NETWORK-BASED AIR-CONDITIONING EQUIPMENT REMOTE MONITORING AND MANAGEMENT SYSTEM

(75) Inventors: Yu-Huan Wang, Taipei (TW); Shu-Fen Lin, Taipei (TW); Shiue-Juan Liao, Taipei (TW); Chun-Hung Huang, Taipei (TW); Chien-Yuan Chen, Taipei (TW)

(73) Assignee: Chunghwa Telecom Co., Ltd., Taipei (TW)

( * ) Notice: Subject to any disclaimer, the term of this patent is extended or adjusted under 35 U.S.C. 154(b) by 151 days.

(21) Appl. No.: 11/868,385

(22) Filed: Oct. 5, 2007

(65) Prior Publication Data

US 2009/0012650 A1 Jan. 8, 2009

(30) Foreign Application Priority Data

Jul. 6, 2007 (TW) ..... 96124627 A

(51) Int. Cl.

| | |
|---|---|
| ***G01M 1/38*** | (2006.01) |
| ***G05B 13/00*** | (2006.01) |
| ***G05B 15/00*** | (2006.01) |
| ***G05D 23/00*** | (2006.01) |

(52) U.S. Cl. ..... 700/276; 700/277; 700/278; 236/1 B; 236/1 C; 165/201; 165/203

(58) Field of Classification Search ..... 700/276, 700/277, 278; 236/1 B, 1 C; 165/201, 203
See application file for complete search history.

(56) References Cited

U.S. PATENT DOCUMENTS

| | | | | |
|---|---|---|---|---|
| 5,751,572 | A * | 5/1998 | Maciulewicz | 700/3 |
| 6,121,593 | A * | 9/2000 | Mansbery et al. | 219/679 |
| 6,241,156 | B1 * | 6/2001 | Kline et al. | 236/49.3 |
| 7,047,092 | B2 * | 5/2006 | Wimsatt | 700/83 |
| 7,092,794 | B1 * | 8/2006 | Hill et al. | 700/276 |
| 7,133,748 | B2 * | 11/2006 | Robinson | 700/276 |
| 2006/0020426 | A1 * | 1/2006 | Singh | 702/188 |
| 2006/0230270 | A1 * | 10/2006 | Goffin | 713/173 |

* cited by examiner

*Primary Examiner*—Ramesh B Patel

(57) ABSTRACT

A network-based air-conditioning equipment remote monitoring and management system is proposed, which is designed for use with a network system to allow the user to carry out monitoring and management tasks on one or more remotely-located air-conditioning equipment systems in a real-time manner via the network system. The proposed system is characterized by the provision of a user-operated network-based real-time monitoring and management function for remotely-located air-conditioning equipment, the capability to provide efficient and cost-effective management in the utilization of air-conditioning equipment for saving energy and cost, and the capability to provide real-time warning of abnormal operating conditions of the air-conditioning equipment.

10 Claims, 3 Drawing Sheets

NETWORK-BASED AIR-CONDITIONING EQUIPMENT REMOTE MONITORING AND MANAGEMENT SYSTEM

BACKGROUND OF THE INVENTION

1. Field of the Invention

This invention relates to network-based remote monitoring technology, and more particularly, to a network-based air-conditioning equipment remote monitoring and management system which allows the user to remotely monitor and perform management tasks on one or more sets of remotely-located air-conditioning equipment systems in a real-time manner via a network system.

2. Description of Related Art

Air-conditioning apparatuses are electricity-consuming devices that are widely installed in nearly all kinds of buildings, including office buildings, factories, hotels, restaurants, hospitals, supermarkets, warehouses, department stores, to name just a few. Air-conditioning equipment systems installed in buildings typically include AHU (Air Handling Unit), PAH (Precooling Air Handler), and FCU (Fan Coil Unit). Basically, these air-conditioning apparatuses are used together to provide a confined room with a moderate temperature level and an adequate amount of oxygen that allow people staying in the room to feel and breathe comfortably.

In the supervisory management of air-conditioning equipment systems installed in buildings, the management personnel usually need to monitor the operating status of the air-conditioning equipment systems during operation. For example, the management personnel need to inspect the ON/OFF state, electricity consumption conditions (load voltage, load current, and power consumption in watts), and whether the air-conditioned room is conditioned to the desired temperature, humidity, and low concentration of carbon-dioxide. Moreover, the management personnel need to constantly check whether all the individual units (i.e., AHU, PAH, FCU, etc.) in the air-conditioning equipment system operate normally. If any individual unit fails to operate normally, the management personnel need to promptly repair or replace the bad unit in order to maintain operability and serviceability of the air-conditioning equipment system. In addition, for energy saving purposes, the management personnel need to learn the total power consumption by each air-conditioning equipment system during a certain period, so that it can be used as a reference for efficient and cost-effective management in the utilization of the air-conditioning equipment systems to save energy and cost.

Traditionally, the above-mentioned air-conditioning equipment monitoring and management tasks are carried out by human labor, i.e., the inspection of the operating status (temperature, humidity, air-blowing speed) is carried out through visual inspection by the management personnel, and the recording of operating characteristics data (i.e., load voltage, load current, and power consumption in watts) is carried out by visually inspecting electronic instruments and then handwriting on papers. When it is required to analyze these operating characteristics data to learn the energy consumption by the air-conditioning equipment, the management personnel then need to perform calculations and analysis through handwork and paperwork.

One apparent drawback to the above-mentioned practice is that the involved paperwork and handwork is highly tedious, laborious, and time-consuming and therefore highly inefficient for the management personnel to implement. In addition, in the event of an abnormal operating condition of the air-conditioning equipment, the management personnel usually cannot be informed of this condition promptly in real time, thus causing a delay to the maintenance/repair work that would undesirably interrupt the serviceability of the air-conditioning equipment.

SUMMARY OF THE INVENTION

It is therefore an objective of this invention to provide a network-based air-conditioning equipment remote monitoring and management system which allows the management personnel to remotely monitor a remotely-located air-conditioning equipment system in a real-time manner via a network system.

It is another objective of this invention to provide a network-based air-conditioning equipment remote monitoring and management system which allows the management personnel to be promptly informed of an abnormal operating condition in a remotely located air-conditioning equipment system in a real-time manner so that the failed air-conditioning equipment system can be repaired or replaced immediately without delay.

In construction, the network-based air-conditioning equipment remote monitoring and management system according to the invention is based on a distributed architecture comprising: (A) a server-side unit; and (B) an equipment-side unit; wherein the server-side unit is installed on one or more servers and whose internal architecture includes: (A0) a remote network communication module; (A1) a user interface module; and (A2) an operation data storage module; and can further optionally include: (A3) a prescheduled operation data analyzing module; and wherein the equipment-side unit is integrated to each air-conditioning apparatus and whose internal architecture includes: (B0) a network linking module; (B1) an equipment-side server module; and (B2) an operating-status monitoring module which is composed of an operation inspection mechanism and an operation control mechanism.

Compared to prior art, the network-based air-conditioning equipment remote monitoring and management system according to the invention has the following features: (1) the provision of a network-based real-time monitoring and management function for user-operated monitoring and management of remotely-located air-conditioning equipment systems through a GUI-based user interface displayed on the client workstation, which allows the management personnel to be remotely informed of all operating status of the air-conditioning equipment systems, to remotely set desired operating conditions, and to achieve optimal utilization of the air-conditioning equipment systems; (2) the capability to provide efficient and cost-effective management on the air-conditioning equipment systems for saving energy and cost; and (3) the capability to provide real-time warning of abnormal operating conditions of the air-conditioning equipment systems, which allows the management personnel to maintain operability and serviceability of the air-conditioning equipment systems.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENTS

The network-based air-conditioning equipment remote monitoring and management system according to the invention is disclosed in full details by way of preferred embodiments in the following with reference to the accompanying drawings.

Figure 1:
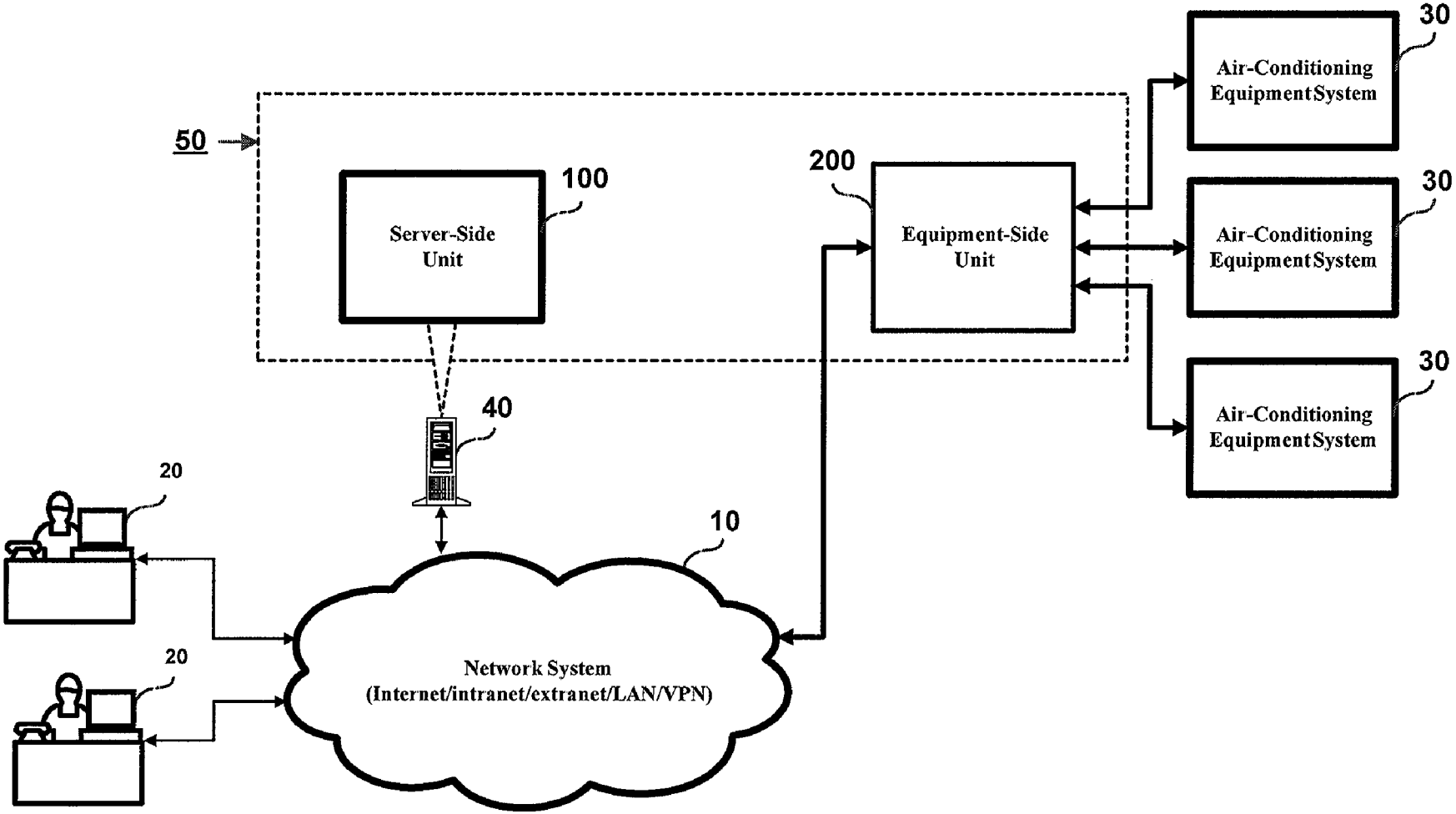
FIG. 1 is a schematic diagram showing the application and distributed architecture of the network-based air-conditioning equipment remote monitoring and management system of the invention in conjunction with a network system.

FIG. 1 is a schematic diagram showing the application and distributed architecture of the network-based air-conditioning equipment remote monitoring and management system according to the invention (as the part enclosed in the dotted box indicated by the reference numeral 50). As shown, the network-based air-conditioning equipment remote monitoring and management system of the invention 50 is designed for use in conjunction with a network system 10, such as the Internet, an intranet system, an extranet system, a wired-type LAN (Local Area Network) system, a wireless-type LAN system, or a VPN (Virtual Private Network) system, and which is capable of allowing one or more users (i.e., management personnel) to remotely monitor and perform management tasks on one or more sets of remotely-located air-conditioning equipment systems 30 in a real-time manner via the network system 10 (in the embodiment of FIG. 1, only 3 sets of air-conditioning equipment systems 30 are shown for demonstrative purpose; but in practice, the number of air-conditioning equipment systems that can be remotely monitored by the invention is unrestricted). In practice, each air-conditioning equipment system 30 is composed of a temperature-adjusting mechanism 31, a humidity-adjusting mechanism 32, and an air-inhaling mechanism 33; wherein the temperature-adjusting mechanism 31 is for example an air conditioner capable of producing a stream of cooled air or heated air for adjusting the temperature of air within a confined room; the humidity-adjusting mechanism 32 is a for example a dehumidifier capable of adjusting the humidity within the confined room; and the air-inhaling mechanism 33 is for example a fan coil unit, particularly of the type having a precooling capability such as PAH, that is capable of inhaling outdoor air and precooling the inhaled air before injected the inhaled air into the confined room.

Figure 2A:
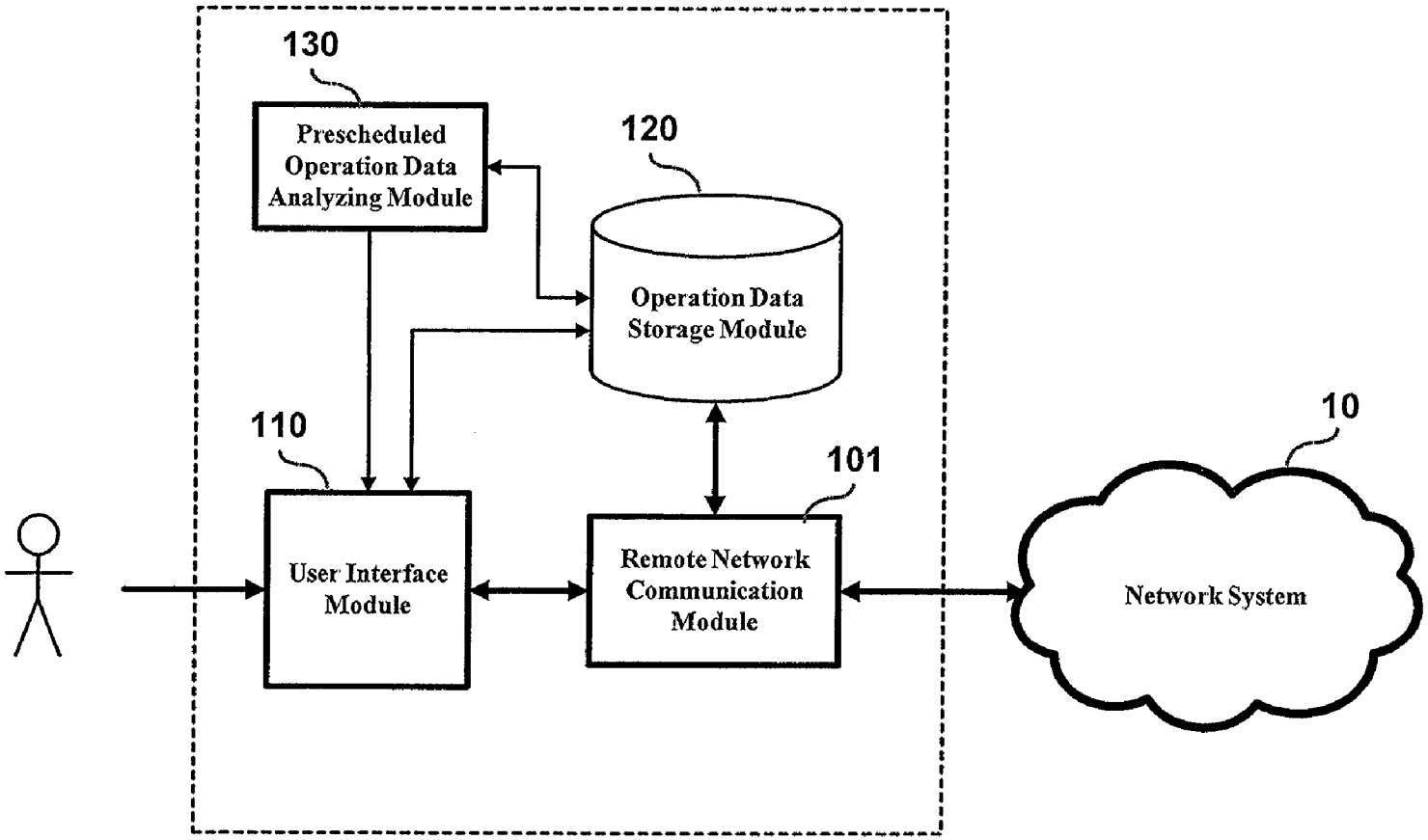
FIG. 2A is a schematic diagram showing the internal architecture of the server-side unit utilized by the network-based air-conditioning equipment remote monitoring and management system of the invention.
Figure 2B:
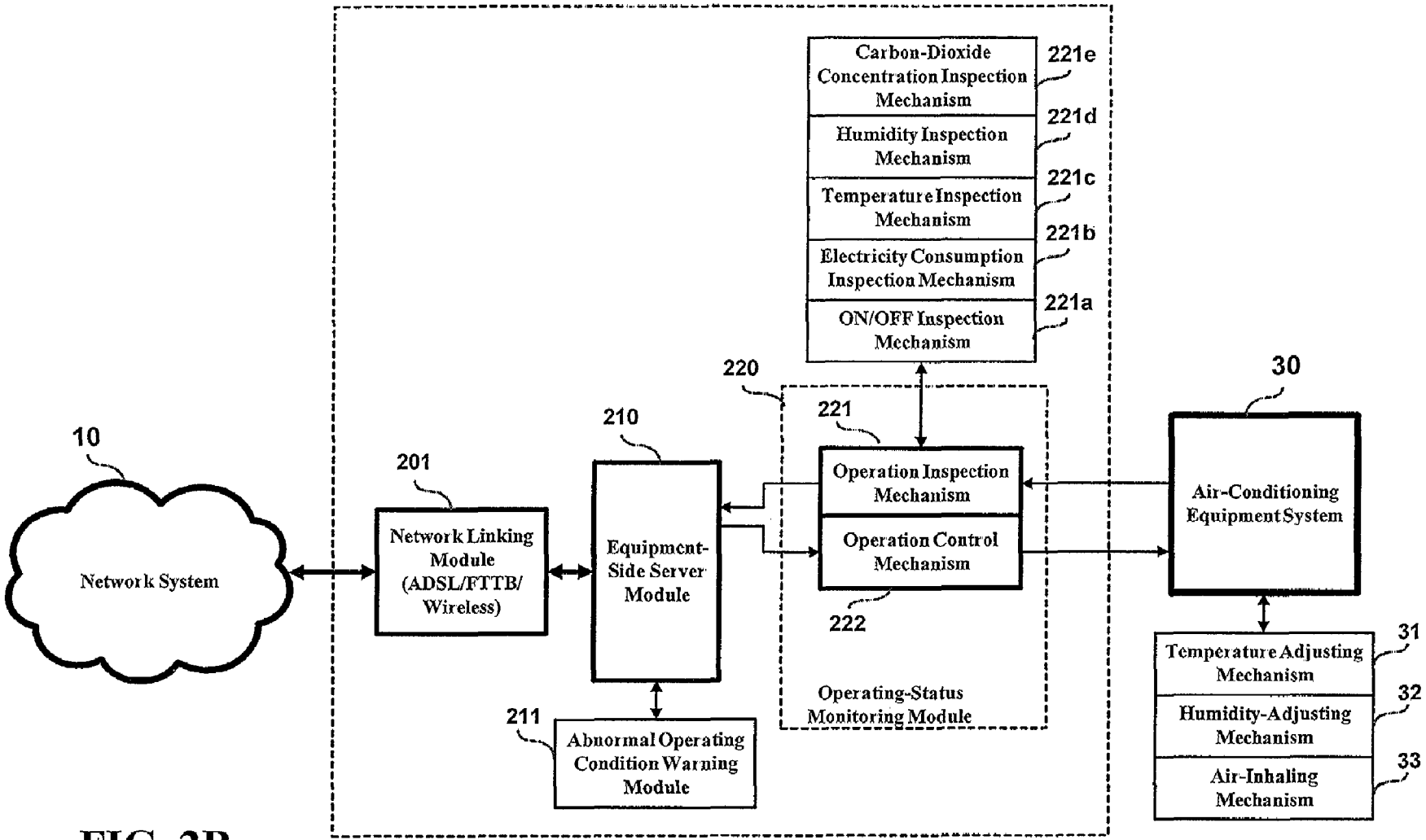
FIG. 2B is a schematic diagram showing the internal architecture of the equipment-side unit utilized by the network-based air-conditioning equipment remote monitoring and management system of the invention.

As shown in FIG. 1, in construction, the network-based air-conditioning equipment remote monitoring and management system of the invention 50 is based on a distributed architecture comprising two separate units: (A) a server-side unit 100; and (B) an equipment-side unit 200; wherein as shown in FIG. 2A the server-side unit 100 is installed on one or more servers 40 and whose internal architecture includes: (A0) a remote network communication module 101; (A1) a user interface module 110; and (A2) an operation data storage module 120; and can further optionally include a prescheduled operation data analyzing module 130; and further as shown in FIG. 2B, the equipment-side unit 200 is integrated to each set of air-conditioning equipment system 30 and whose internal architecture includes: (B0) a network linking module 201; (B1) an equipment-side server module 210; and (B2) an operating-status monitoring module 220 which is composed of an operation inspection mechanism 221 and an operation control mechanism 222. In practical implementation, for example, the server-side unit 100 can be entirely implemented with a computer software program for installation to the server 40, while the network linking module 201, the equipment-side server module 210, and the operating-status monitoring module 220 are all hardware modules.

Firstly, the respective attributes and behaviors of the constituent modules of the server-side unit 100 are described in details in the following.

The remote network communication module 101 is used to allow the server-side unit 100 to communicate with the equipment-side unit 200 via the network system 10 for receiving the data of operating characteristics of each air-conditioning equipment system 30 uploaded from the equipment-side unit 200 via the network system 10 to the server-side unit 100, and for downloading each user-specified air-conditioning control command from the server-side unit 100 to the equipment-side unit 200 via the network system 10. The operating characteristics data collected from each air-conditioning equipment system 30 include, for example, current ON/OFF state, current temperature setting, current humidity setting, current air-blowing speed setting, detected temperature level, detected humidity level, detected concentration of carbon dioxide, and current electricity consumption conditions (load voltage, load current, and power consumption in watts).

The user interface module 110 is used to provide a user interface, such as a GUI (Graphic User Interface) based user interface, to each client workstation 20 being linked to the server 40 for the purpose of allowing the user (i.e., management personnel) at the client workstation 20 to operate the network-based air-conditioning equipment remote monitoring and management system of the invention 50. When linked to the client workstation 20, the user interface module 110 is capable of providing the user at the client workstation 20 with the following functions: (1) an equipment operating-status displaying function, (2) a human-operated control command issuing function, and (3) a human-operated equipment operation scheduling function. The equipment operating-status displaying function is used to display a set of operating characteristics data indicative of the operating status of each remotely-located air-conditioning equipment system 30 as well as a set of related product and management information about each air-conditioning equipment system 30. The displayed operating characteristics data includes current ON/OFF state, current temperature setting and detected temperature level, current humidity setting and detected humidity level, current air-blowing speed setting, currently detected concentration of carbon dioxide, and current electricity consumption conditions (load voltage, load current, and power consumption in watts); and the related product and management information includes, for example, name of manufacturer, serial number, product specification, name of purchaser, date of purchase, warranty period, installation site, name of supervisory personnel, and maintenance/repair record, to name a few. The human-operated control command issuing function provides a set of air-conditioning control commands in relation to the operation of each air-conditioning equipment system 30 for user selection. When the user selects an air-conditioning control command, the user interface module 110 will send the user-selected command via the network system 10 to the equipment-side unit 200 for control of the user-designated one of the air-conditioning equipment systems 30. The air-conditioning control command set includes, for example, an ON/OFF switch command, a temperature-adjusting command (which specifies the user-desired temperature level to be provided by the temperature-adjusting mechanism 31), a humidity-adjusting command (which specifies the user-desired humidity level to be provided by the humidity-adjusting mechanism 32), and an air-blowing speed adjusting command (which specifies the user-desired air-blowing speed to be provided by the air-inhaling mechanism 33). The human-operated equipment operation scheduling function allows the management personnel to specify a preassigned operation time period for each air-conditioning equipment system 30, such as 7:50 AM to 17:00 PM of each workday, during which the air-conditioning equipment system 30 are enabled to an operable status so that they can be switched on for use by the on-site users. Beyond this time period, the air-conditioning equipment systems 30 will be disabled for operation.

The operation data storage module 120 is a database module used for storage of the operating characteristics data (i.e., ON/OFF state, temperature setting, humidity setting, air-blowing speed setting, and electricity consumption conditions (load voltage, load current, and power consumption in watts) of each remotely-located air-conditioning equipment system 30 during each workday, which represent the operation history of each air-conditioning equipment system 30. These data can be displayed through the user interface module 110 on the client workstation 20 for the user to browse. In addition, this operation data storage module 120 is also used for storage of related product and management information about each remotely-located air-conditioning equipment system 30, including, for example, name of manufacturer, serial number, product specification, name of purchaser, date of purchase, warranty period, installation site, name of supervisory personnel, and maintenance/repair record.

The prescheduled operation data analyzing module 130 is capable of automatically generating an electricity consumption analysis report in the form of an electronic document based on the operating characteristics data of each air-conditioning equipment system 30 that have been collected daily during a predefined time period, such as three months, six months, or one year. The electricity consumption analysis report can be used to indicate the total power consumption in watts of each air-conditioning equipment system 30 as well as the date/time and duration when the air-conditioning equipment systems 30 were turned on. The management personnel can browse or print a copy of the electricity consumption analysis report by operating through the user interface module 110 on the client workstation 20. The contents of this electricity consumption analysis report can be used by the management personnel as a reference for efficient and cost-effective management in the utilization of the air-conditioning equipment systems 30 to save energy and cost.

Next, the respective attributes and behaviors of the constituent modules of the equipment-side unit 200 are described in details in the following.

The network linking module 201 is used to link the equipment-side unit 200 to the network system 10. In practice, the network linking module 201 can be either an ADSL (Asynchronous Digital Subscriber Line) type, an FTTB (Fiber To The Building) type, or a wireless type of network linking device, and which is used to allow the equipment-side unit 200 to exchange data with the server-side unit 100 via the network system 10.

The equipment-side server module 210 is linked to the network linking module 201, and which is used to collect the operating characteristics data detected by the operation inspection mechanism 221 from each air-conditioning equipment system 30, and further capable of uploading the collected data via the network system 10 to the server-side unit 100. In addition, the equipment-side server module 210 is capable of forwarding each received air-conditioning control command downloaded from the server-side unit 100 to the respective operation control mechanism 222 of the air-conditioning equipment systems 30. In the embodiment of FIG. 1, for example, the network linking module 201 is shown to be connected to only one unit of equipment-side server module 210; but the number of units that can be connected to the network linking module 201 is unrestricted and dependent on the linking capacity (i.e., number of connecting ports) of the network linking module 201. Moreover, the equipment-side server module 210 further includes an abnormal operating condition warning module 211 which is capable of generating a warning message in response to an event that the operation inspection mechanism 221 detects an abnormal operating condition of the air-conditioning equipment system 30. The warning message will be transferred via the network system 10 to the server-side unit 100 so that the management personnel can be informed of this abnormal operating condition via the client workstation 20 and carry out necessary maintenance/repair tasks on the failed air-conditioning equipment system 30. In practice, for example, the abnormal operating condition warning module 211 can be implemented in such a manner that after the server-side unit 100 issues an air-conditioning control command to the air-conditioning equipment system 30, the operation inspection mechanism 221 will be activated to inspect whether the air-conditioning equipment system 30 operates in a manner specified by the air-conditioning control command; if NOT, the abnormal operating condition warning module 211 will promptly issues the warning message. For example, when the management personnel wants to set the air-conditioning equipment system 30 to adjust the room temperature to 25° C., then the management personnel can operate the user interface module 110 to specify the desired temperature level (i.e., 25° C.), which causes the user interface module 110 to issue a corresponding air-conditioning control command via the network system 10 to the air-conditioning equipment system 30. In response to this command, the temperature-adjusting mechanism 31 of the air-conditioning equipment system 30 will produce a stream of cooled air to the air-conditioned room; and meanwhile the operation inspection mechanism 221 will be activated to inspect whether the air-conditioned temperature inside the room is equal to the user-specified level of 25° C. If NOT (for example the room temperature remains at 28° C. continuously for 30 minutes), then the abnormal operating condition warning module 211 will promptly issue a warning message via the network system 10 to the client workstation 20 for informing the management personnel to carry out necessary maintenance/repair tasks on the failed temperature-adjusting mechanism 31 of the air-conditioning equipment system 30.

The operation inspection mechanism 221 of the operating-status monitoring module 220 is capable of inspecting the operating status of each air-conditioning equipment system 30 during operation to obtain the operating characteristics thereof, and further capable of sending the detected operating characteristics data to the equipment-side server module 210 for uploading via the network system 10 to the server-side unit 100. In practical implementation, for example, the operation inspection mechanism 221 includes an ON/OFF inspection mechanism 221*a*, an electricity consumption inspection mechanism 221*b*, a temperature inspection mechanism 221*c*, a humidity inspection mechanism 221*d*, and a carbon-dioxide concentration inspection mechanism 221*e*. The ON/OFF inspection mechanism 221*a* is used to inspect the ON/OFF state of each air-conditioning equipment system 30. The electricity consumption inspection mechanism 221*b* is used to inspect the current electricity consumption conditions (i.e., load voltage, load current, and power consumption in watts) of each air-conditioning equipment system 30. The temperature inspection mechanism 221*c* is a temperature sensor capable of detecting the temperature of air within the air-conditioned room. The humidity inspection mechanism 221*d* is a humidity sensor capable of detecting the humidity of air within the air-conditioned room. The carbon-dioxide concentration inspection mechanism 221*e* is a gas sensor capable of detecting the concentration of carbon dioxide within the air-conditioned room.

On the other hand, the operation control mechanism 222 of the operating-status monitoring module 220 is capable of controlling each air-conditioning equipment system 30 to operate in a user-specified manner based on each air-conditioning control command downloaded from the server-side unit 100 via the network system 10. For example, each air-conditioning equipment system 30 can be remotely controlled by the management personnel to operate in a user-specified manner. The user-controllable operating states include, for example, ON/OFF state, temperature, humidity, and air-blowing speed for inhaling outdoor air to the inside.

The following is a detailed description of a practical application example of the network-based air-conditioning equipment remote monitoring and management system of the invention 50 during actual operation.

In actual application, the management personnel can operate the network-based air-conditioning equipment remote monitoring and management system of the invention 50 for remote monitoring and management of the air-conditioning equipment systems 30 by first linking his/her client workstation 20 via the network system 10 to the server 40. When linked, the management personnel can turn ON/OFF the air-conditioning equipment systems 30 through the user interface module 110 and specify a desired temperature setting, a desired humidity setting, and a desired air-blowing speed setting for operation by each air-conditioning equipment system 30. The user interface module 110 will respond to each user-initiated control action by issuing a corresponding air-conditioning control command and then activating the remote network communication module 101 to download the command via the network system 10 to the equipment-side unit 200.

When the network linking module 201 in the equipment-side unit 200 receives the air-conditioning control command via the network system 10 from the server-side unit 100, it will transfer the received command to the equipment-side server module 210 where the received command is decoded into a corresponding control signal and then transferred to the operation control mechanism 222 which will respond by turning on the air-conditioning equipment system 30 and setting the air-conditioning equipment system 30 to operate based on user-specified settings.

When the air-conditioning equipment system 30 is turned ON and started running, the operation inspection mechanism 221 is activated to inspect the air-conditioning equipment system 30 for its operating characteristics, and then send the detected data to the equipment-side server module 210 for uploading via the network system 10 to the server-side unit 100. The detected operating characteristics data include, for example, current ON/OFF state, current electricity consumption conditions (load voltage, load current, and power consumption in watts), actual temperature level, actual humidity level, current concentration of carbon dioxide, and current air-blowing speed.

When the server-side unit 100 receives the uploaded operating characteristics data, it will store these data into the operation data storage module 120 for permanent storage and archives The management personnel can browse these data through the user interface module 110 on the client workstation 20 to learn all current and previous operating status of each air-conditioning equipment system 30.

Furthermore, the network-based air-conditioning equipment remote monitoring and management system of the invention 50 is capable of providing an air-quality monitoring function to the air-conditioned room. In the implementation of this function, the carbon-dioxide concentration inspection mechanism 221*e* shown in FIG. 3 is used to detect the concentration of carbon dioxide within the air-conditioned room, and the detected value is then transferred to the equipment-side server module 210 where the detected value of carbon dioxide concentration is compared against a predefined critical value to check if it is higher than the critical value. If YES, the equipment-side server module 210 will issue an air-blowing speed control signal to the operation control mechanism 222 for controlling the air-inhaling mechanism 33 of the air-conditioning equipment system 30, which is for example a PAH (Precooling Air Handler) in this embodiment, to increase its air-blowing speed for the purpose of inhaling more fresh outdoor air into the confined room. Further, the related status data about this operation is uploaded via the network system 10 to the server-side unit 100 so that the management personnel can be informed of the status of this operation. If the concentration of carbon dioxide within the air-conditioned room remains overly high after the air-blowing speed has been increased to the maximum for a while, the management personnel will notify the on-site personnel, for example by phone call, to take other actions such as to open some doors and windows of the air-conditioned room in order to let in more fresh air.

In the event that an abnormal operating condition occurs to any individual unit of each air-conditioning equipment system 30, the equipment-side server module 210 will respond by issuing a warning message to the server-side unit 100 for display on the client workstation 20 to notify the management personnel to take necessary maintenance/repair task on the failed air-conditioning equipment system 30. This warning function can be implemented in such a manner that the operation inspection mechanism 221 is used to detect the actual operating status of each air-conditioning equipment system 30 during operation, and the detected status data is then compared by the abnormal operating condition warning module 211 against the user-specified setting to check if the detected value is equal or within a predefined range about the user-specified value; if NOT, the warning message is issued. For example, when the management personnel sets the desired temperature level to 25° C., the user interface module 110 will issue a corresponding air-conditioning control command via the network system 10 to the air-conditioning equipment system 30. In response to this command, the temperature-adjusting mechanism 31 of the air-conditioning equipment system 30 will produce a stream of cooled air to the room; and meanwhile, the operation inspection mechanism 221 will be activated to inspect whether the actual temperature of air inside the room is equal or within a range about the user-specified level of 25° C. If NOT (for example the room temperature remains at 28° C. continuously for 30 minutes), then the abnormal operating condition warning module 211 will promptly issue a warning message via the network system 10 to the client workstation 20 for informing the management personnel to carry out necessary maintenance/repair tasks on the failed temperature-adjusting mechanism 31 of the air-conditioning equipment system 30.

After the air-conditioning equipment systems 30 have been in operation for a predefined time period, for example 3 months, the prescheduled operation data analyzing module 130 will be automatically activated to generate an electricity consumption analysis report in the form of an electronic document based on the operating characteristics data of each air-conditioning equipment system 30 stored in the operation data storage module 120. The electricity consumption analysis report is used to indicate, for example, the total power consumption in watts of each air-conditioning equipment system 30 as well as the date/time and duration when the air-conditioning equipment systems 30 were turned on. The management personnel can browse or print a copy of the electricity consumption analysis report by operating through the user interface module 110 on the client workstation 20. The contents of this electricity consumption analysis report can be used by the management personnel as a reference for efficient and cost-effective management in the utilization of the air-conditioning equipment systems 30 to save energy and cost. For example, 8:00 AM is the start time for a typical workday, and during summer office workers would usually turn on air conditioners to the maximum capacity in hope for a rapid cooling effect when they start working at 8:00 AM. For this sake, utility electricity consumption would typically peaks at 8:00 AM. As a result, switching on the air conditioner at this time is inefficient and cost-ineffective to provide the desired cooling effect. As a solution to this problem, the management personnel can utilize the equipment operation scheduling function of the user interface module 110 to set the air-conditioning equipment system 30 to be automatically switched on at an earlier time, for example 7:30 AM. This practice allows the air-conditioning equipment system 30 to run early at a non-peak time for efficient and cost-effective operation and also allows the office room to be readily cooled to the desired temperature level at 8:00 AM when office workers start working.

In conclusion, the invention provides a network-based air-conditioning equipment remote monitoring and management system which has the following features: (1) the provision of a network-based real-time monitoring and management function for user-operated monitoring and management of remotely-located air-conditioning equipment systems through a GUI-based user interface displayed on the client workstation, which allows the management personnel to be remotely informed of all operating status of the air-conditioning equipment systems, to remotely set desired operating conditions, and to achieve optimal utilization of the air-conditioning equipment systems; (2) the capability to provide efficient and cost-effective management on the air-conditioning equipment systems for saving energy and cost; and (3) the capability to provide real-time warning of abnormal operating conditions of the air-conditioning equipment systems, which allows the management personnel to maintain operability and serviceability of the air-conditioning equipment systems. The invention is therefore more advantageous to use than the prior art.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A network-based air-conditioning equipment remote monitoring and management system for use to integrate to a network system for providing a user-operated monitoring and management function on at least one set of remotely-located air-conditioning equipment system;

the network-based air-conditioning equipment remote monitoring and management system being based on a distributed architecture comprising a server-side unit and an equipment-side unit; wherein the server-side unit is integrated to a server linked to the network system and is capable of allowing a client workstation to be linked via the network system to the server for user-operated monitoring and management tasks on the air-conditioning equipment system, and which includes:

a remote network communication module, which is used to allow the server-side unit to communicate with the equipment-side unit via the network system;

a user interface module, which is capable of providing a user interface to the client workstation being linked to the server, and capable of providing an equipment operating-status displaying function and a human-operated control command issuing function; wherein the equipment operating-status displaying function is capable of displaying a set of operating status data about the air-conditioning equipment system, while the human-operated control command issuing function is capable of providing a set of air-conditioning control commands for user selection and issuing each user-selected air-conditioning control command via the network system to the air-conditioning equipment system; and an operation data storage module, which is used for storage of a set of operation data about the air-conditioning equipment system downloaded from the equipment-side unit and capable of displaying the operation data on the client workstation through the user interface module; and wherein the equipment-side unit is integrated to the air-conditioning equipment system and linked to the network system, and which includes:

a network linking module, which is capable of linking the equipment-side unit to the network system;

an equipment-side server module, which is linked to the network linking module and capable of providing a two-way data communication function between the air-conditioning equipment system and the server-side unit; and an operating-status monitoring module, which includes an operation inspection mechanism and an operation control mechanism; wherein the operation inspection mechanism is capable of inspecting the operating status of the air-conditioning equipment system during operation to acquire a set of operating characteristics data thereof, and further capable of sending the detected operating characteristics data to the equipment-side server module for transfer to the server-side unit via the network system; while the operation control mechanism is capable of controlling the air-conditioning equipment system to operate in a user-specified manner based on each air-conditioning control command downloaded from the server-side unit via the network system.

2. The network-based air-conditioning equipment remote monitoring and management system of claim 1, wherein the network system is Internet, an intranet system, an extranet system, a wired-type LAN (Local Area Network) system, a wireless-type LAN system, or a VPN (Virtual Private Network) system.

3. The network-based air-conditioning equipment remote monitoring and management system of claim 1, wherein the equipment-side server module in the equipment-side unit further includes:

an abnormal operating condition warning module, which is capable of generating a warning message for transfer via the network system to the client workstation in the event that the operation inspection mechanism detects an abnormal operating condition in the air-conditioning equipment system.

4. The network-based air-conditioning equipment remote monitoring and management system of claim 1, wherein the server-side unit further includes:

a prescheduled operation data analyzing module, which is capable of automatically generating an electricity consumption analysis report in the form of an electronic document based on the operating characteristics data of each air-conditioning equipment system during a predefined period.

5. The network-based air-conditioning equipment remote monitoring and management system of claim 1, wherein the network linking module is an ADSL (Asynchronous Digital Subscriber Line) type of network linking device.

6. The network-based air-conditioning equipment remote monitoring and management system of claim 1, wherein the network linking module is an FTTB (Fiber To The Building) type of network linking device.

7. The network-based air-conditioning equipment remote monitoring and management system of claim 1, wherein the network linking module is a wireless type of network linking device.

8. The network-based air-conditioning equipment remote monitoring and management system of claim 1, wherein the operation data storage module is further used for storage of related product and management information about the air-conditioning equipment system.

9. The network-based air-conditioning equipment remote monitoring and management system of claim 1, wherein the operation inspection mechanism includes:

an ON/OFF inspection mechanism, which is capable of inspecting the ON/OFF state of the air-conditioning equipment system;

an electricity consumption inspection mechanism, which is capable of inspecting the electricity consumption conditions of the air-conditioning equipment system;

a temperature inspection mechanism, which is capable of inspecting the temperature level conditioned by the air-conditioning equipment system;

a humidity inspection mechanism, which is capable of detecting the humidity level conditioned by the air-conditioning equipment system; and a carbon-dioxide concentration inspection mechanism, which is capable of detecting concentration of carbon dioxide within a room where the air-conditioning equipment system is installed.

10. The network-based air-conditioning equipment remote monitoring and management system of claim 1, wherein the user interface module further includes a human-operated equipment operation scheduling function for specifying a preassigned operation time period for the air-conditioning equipment system during which the air-conditioning equipment system is enabled for operation.

* * * * *